United States Patent [19]

Nappi, Sr.

[11] Patent Number: 4,951,345

[45] Date of Patent: Aug. 28, 1990

[54] SELF-CLEANING ENTRY CARPET ASSEMBLY

[75] Inventor: John J. Nappi, Sr., Berlin, Conn.

[73] Assignee: Liberty Products, Inc., Berlin, Conn.

[21] Appl. No.: 368,267

[22] Filed: Jun. 19, 1989

[51] Int. Cl.[5] ..... A47L 23/02; E04F 19/10

[52] U.S. Cl. ..... 15/302; 15/306 A; 15/308; 15/311; 15/306.1

[58] Field of Search ..... 15/302, 306 A, 308, 15/311, 36

[56] References Cited

U.S. PATENT DOCUMENTS

| | | | |
|---|---|---|---|
| 823,972 | 6/1906 | Richardson . | |
| 2,533,781 | 12/1950 | Fallowfield, Jr. . | |
| 2,565,894 | 8/1951 | Stotz . | |
| 2,599,049 | 6/1952 | Dollinger . | |
| 2,860,366 | 11/1958 | Kemp | 15/311 |
| 2,895,159 | 7/1959 | Ostrow | 15/311 |
| 3,308,499 | 3/1967 | Stieger . | |
| 3,346,904 | 10/1967 | Armstrong . | |
| 3,348,252 | 10/1967 | Lightowler . | |
| 3,482,272 | 12/1969 | McLennon . | |
| 3,526,015 | 9/1970 | Nappi . | |
| 3,611,472 | 10/1971 | Kayser . | |
| 4,198,725 | 4/1980 | Trutzschler . | |
| 4,280,244 | 7/1981 | Spirig | 15/36 X |
| 4,361,925 | 12/1982 | Yamamoto et al. . | |

*Primary Examiner*—Chris K. Moore

[57] ABSTRACT

A self-cleaning entry rug assembly has a housing with a hingedly supported top plate extending over substantially its entire top and providing transversely extending openings adjacent its opposite ends. A frame is supported on the top plate and rotatably supports a pair of tread rollers extending in the transversely extending openings of the top plate as well as auxiliary rollers. An endless belt carrying a rug extends about the tread rollers and auxiliary rollers, and a rug cleaning device is provided in the housing below the closed path. One of the auxiliary rollers may be moved on the frame to vary the tension on the belt, and a drive motor effects rotation of the rollers to rotate the belt and rug. A control system controls the drive motor and cleaning device, and it is adapted to receive a signal from a presence sensor adjacent the entry rug assembly to terminate rotation of the rollers upon approach of a person.

22 Claims, 5 Drawing Sheets

10
12
14
16
20
22
24
26
28
101
30
32
34
36
38
39
40
42
44
46

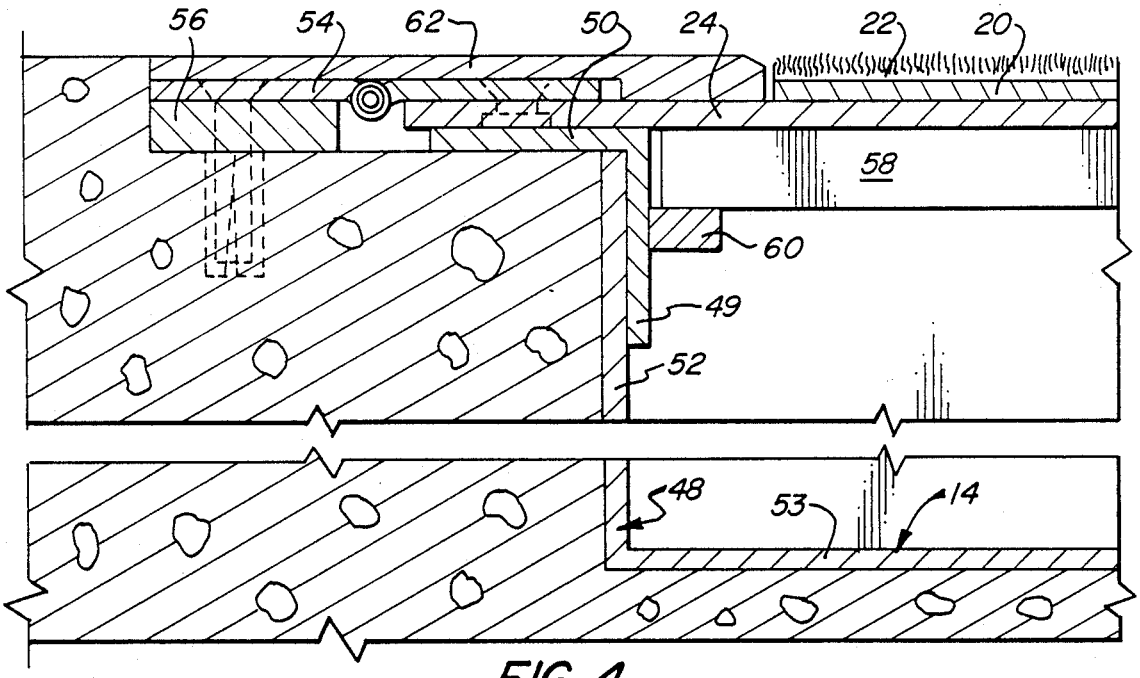
FIG. 4
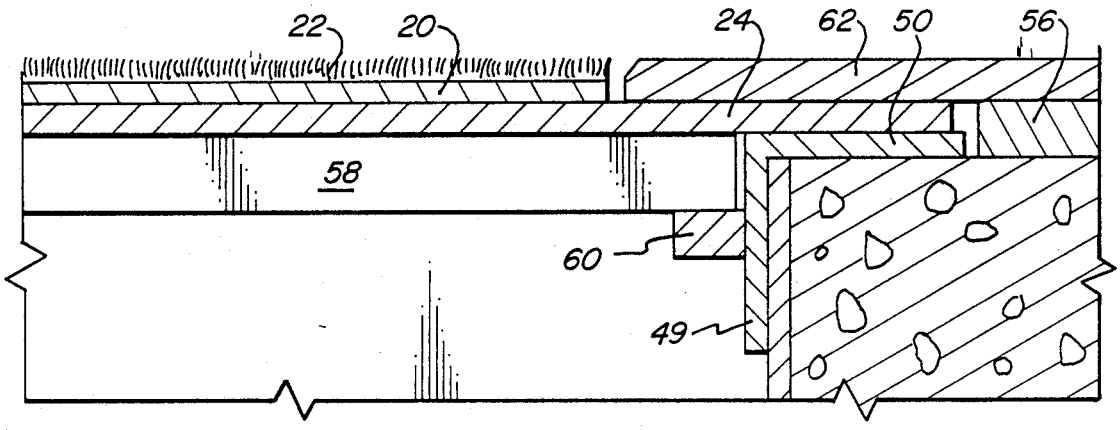
FIG. 5
FIG. 6
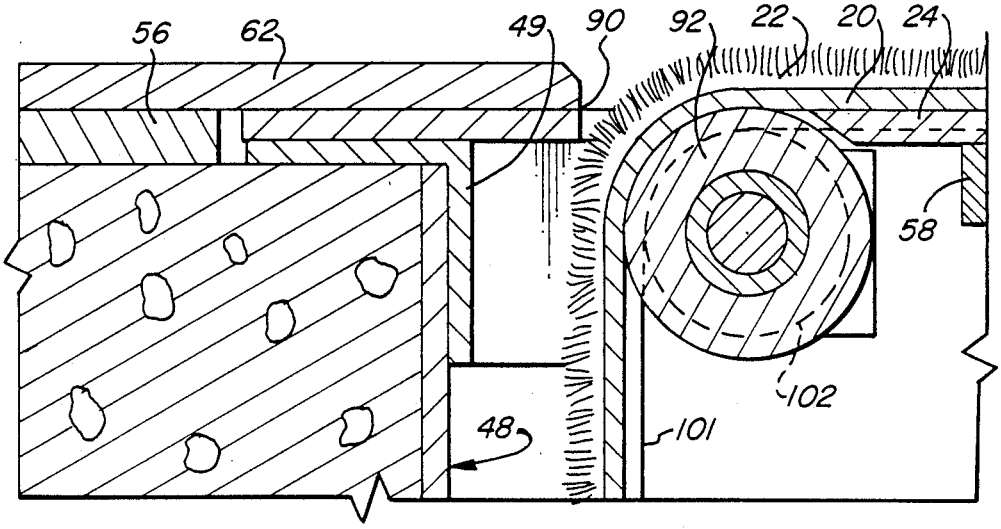

SELF-CLEANING ENTRY CARPET ASSEMBLY

BACKGROUND OF THE INVENTION

The present invention relates to entry rug cleaning assemblies which remove loose soil from the soles of the shoes of persons passing thereover and in which the surface of the rug is cleaned periodically.

In applicant's prior U.S. Pat. No. 3,526,015 granted Sept. 1, 1970, there is disclosed an entry rug cleaning mechanism which has enjoyed commercial acceptance and which has proven quite useful in cleaning and disinfecting the soles of shoes of persons passing thereover into a building. In this installation, the rug is mounted so that it may be rotated about a closed loop, and within an adjacent housing disposed below the traffic surface are vacuum cleaning and washing installations for cleaning the surface of the rug passing thereover.

Self cleaning entry rug installations of this type are extremely desirable from the standpoint that fresh rug surface may be provided to effectively remove soil from the soles of the persons passing thereover and they are able to provide a relatively clean rug surface from an aesthetic standpoint as compared with fixed rug installations for this purpose.

Although the installations of applicant's prior patent have provided substantial benefits, location of the cleaning components outside the belt loop increases the space required for the installation and does not provide optimum cleaning action since the area available for cleaning action is always a vertical portion of the belt loop. Moreover, frequent servicing of the cleaning components has been required.

In addition, replacement of the rug was frequently difficult and time consuming, and the tendency of the rug to stretch required constant adjustment of the tension.

Accordingly, it is an object of the present invention to provide a novel self-cleaning entry rug assembly providing enhanced cleaning action and adapted for facile servicing and relatively trouble free operation.

It is also an object to provide such an entry rug assembly in which the components may be readily fabricated and assembled from relatively durable elements to provide a rugged installation.

Another object is to provide such an entry rug assembly which is adapted to fully automatic control, semi-automatic control, or manual operation.

Still another object is to provide such an assembly which may be linked to presence sensors or approach sensors to limit operation during the time when persons are passing thereover.

SUMMARY OF THE INVENTION

It has now been found that the foregoing and related objects may be readily attained in a self-cleaning entry rug assembly having a housing with a top plate extending over substantially its entire top and hingedly supported on a side thereof. The plate provides transversely extending openings into the housing adjacent its opposite ends, and a frame is supported on the housing and is removable therefrom upon opening of the top plate. A pair of tread rollers is rotatably supported on the frame, and the rollers extend adjacent the transversely extending openings provided by the top plate. Rotatably supported on the frame and extending transversely of the plate below the tread rollers is a multiplicity of auxiliary rollers.

Extending in a closed path about the tread rollers, over the top plate, and about the auxiliary rollers in the housing is an endless belt upon which is supported an endless rug for movement therewith. Cleaning means is provided in the housing below the closed path for cleaning the endless rug, and in the housing there is also means for movement of at least one of the auxiliary rollers to vary the length of the closed path and thereby the tension on the belt, and means for effecting rotation of at least one of the rollers to effect rotation of the belt and thereby the rug. Lastly, there is control means for controlling the rotation means and cleaning means.

In the preferred embodiment, the belt has at least one rib on its lower surface and the top plate has a groove extending longitudinally thereof in which the rib slidably seats. Desirably the tread rollers and the auxiliary rollers have grooves in their circumference in which the rib is seated.

Usually the cleaning means includes a beater and vacuum unit to dislodge and remove particles of dirt and dust from the rug, and a washing unit for spraying a liquid on the rug to wash its surface. The cleaning means also includes conduits extending from the cleaning means in the housing for removal of dirt and to supply and remove washing liquid.

Desirably, the means for moving at least one of the auxiliary rollers includes at least one hydraulic cylinder to effect movement of the auxiliary roller, and the frame is supported on the top plate so as to be movable therewith. The heater and vacuum unit includes a collector and vacuum housing in which a beater brush is supported, and means for moving the housing upwardly against the rug during the cleaning cycle and downwardly thereafter.

In the preferred embodiment, the automatic control means includes a microprocessor which is programmable to vary the operation and sequencing of the operation of the rotation means and cleaning means. The microprocessor also cooperates with the movement means for tensioning the belt and with tension measuring means to maintain substantially predetermined tension on the belt. The automatic control means is adapted to receive a signal from presence sensing means adjacent the entry rug assembly to terminate rotation of the rollers upon approach of a person towards the assembly. The control means also includes means for timing the length of a cleaning cycle to effect operation of the rotation means and the cleaning means for the period of such cycle, to terminate operation of the rotation means and cleaning means during the approach to and passage of a person over the assembly, and then to reinstitute the operation of the rotation and cleaning means until the desired time for the cycle has been completed. Generally, the automatic control means effects operation of the rotation means and cleaning means only after a minimum interval of time during which no signal has been received from the associated presence sensor.

BRIEF DESCRIPTION OF THE DRAWINGS

FIG. 4 is an enlarged fragmentary sectional view of the installation along the hinge side for the top plate;

FIG. 5 is a similar view along the opposite side;

FIG. 6 is a similar view along an end;

DETAILED DESCRIPTION OF THE ILLUSTRATED EMBODIMENT

Figures 1, 1A:
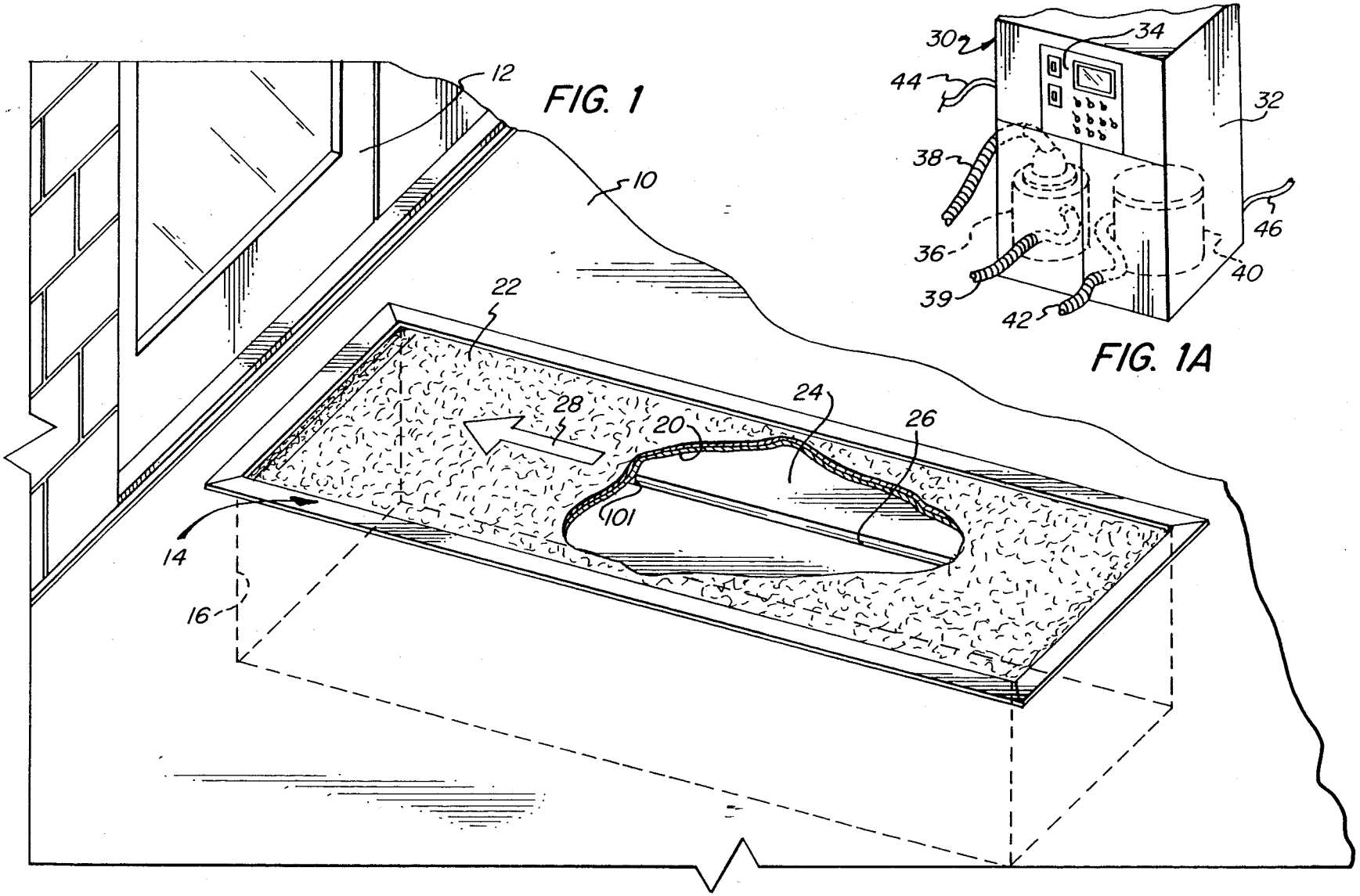
FIG. 1 is a fragmentary perspective view of an entry carpet installation embodying the present invention located adjacent an entry door, and with a portion of the rug and belt broken away to show the top plate.
FIG. 1*a* is a fragmentary perspective view of the adjacent control unit and a housing for dirt and washing liquid.

Turning first to FIG. 1, therein illustrated is an entry rug installation embodying the present invention as placed in the sidewalk 10 adjacent an entry door 12. The installation has a housing generally designated by the numeral 14 seated in a recess 16 in the sidewalk 10. Mounted in the installation for rotation is an endless belt 20 to which is secured an endless rug or carpet 22. Supporting the belt 20 is a top plate 24 with a groove 26 extending longitudinally along the center of its upper surface. The arrow 28 indicates the direction of rotation of the belt 20 and rug 22.

In FIG. 1*a*, there is illustrated the control unit which is generally designated by the numeral 30 and which is desirably placed in a suitable enclosure adjacent the installation. As seen, it has a housing 32 with the control panel 34 and electronics in its upper portion. In the lower portion is shown in phantom line a vacuum 36 with a dirt receptacle, a vacuum conduit 38 extending thereto from the housing 14, and an exhaust conduit 39 leading to the housing. Also located in the housing 32 is a washing fluid container 40 with a conduit 42 extending therefrom to the housing 14. Also shown are the control cable 44 to the housing 14 and a power supply cable 46. These conduits 38, 39, 42 and control cable 44 are located in a subsurface access duct (not shown) to the housing 14.

Figure 2:
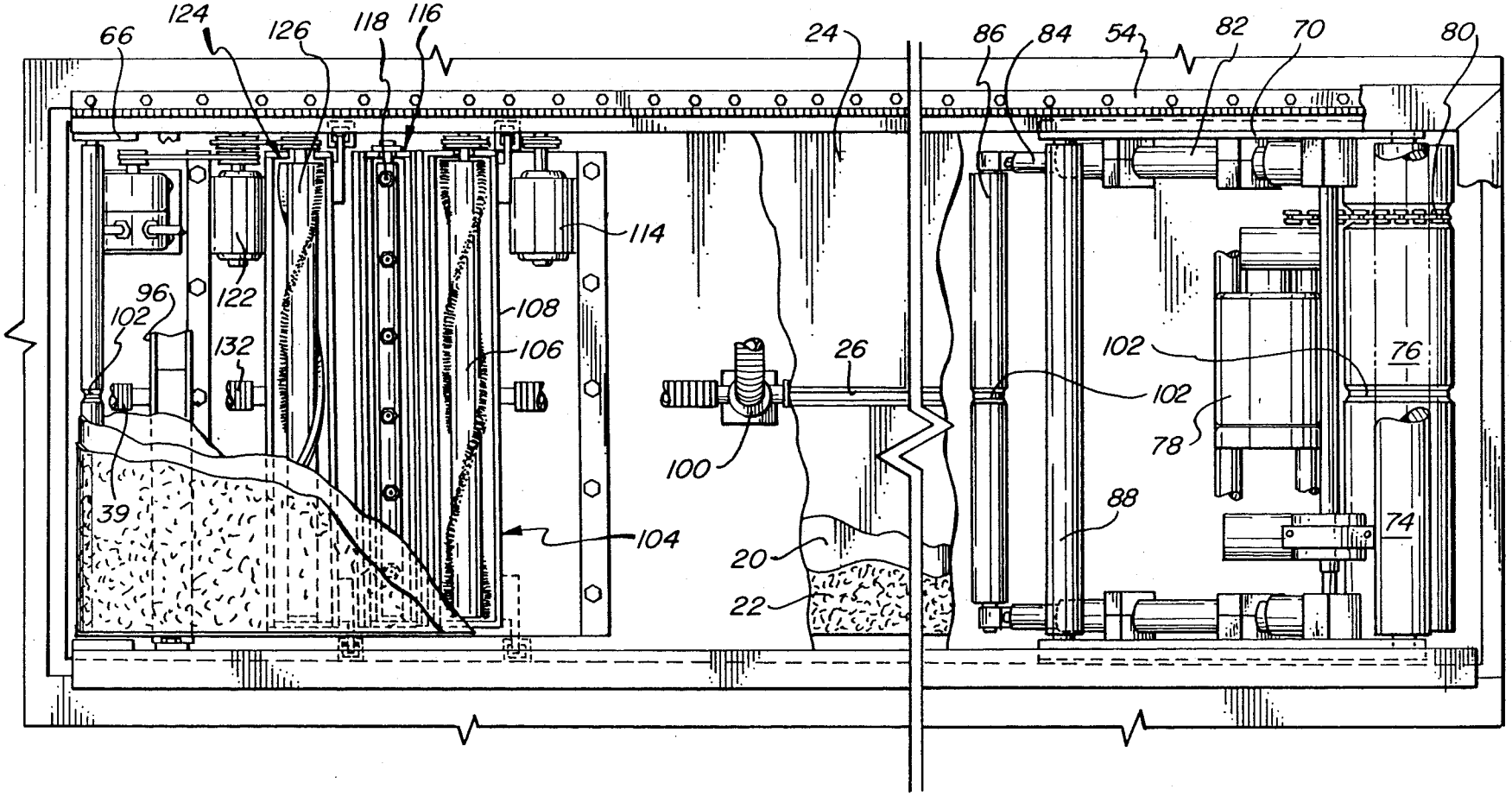
FIG. 2 is a fragmentary top plan view thereof with most of the upper members broken away.
Figure 3:
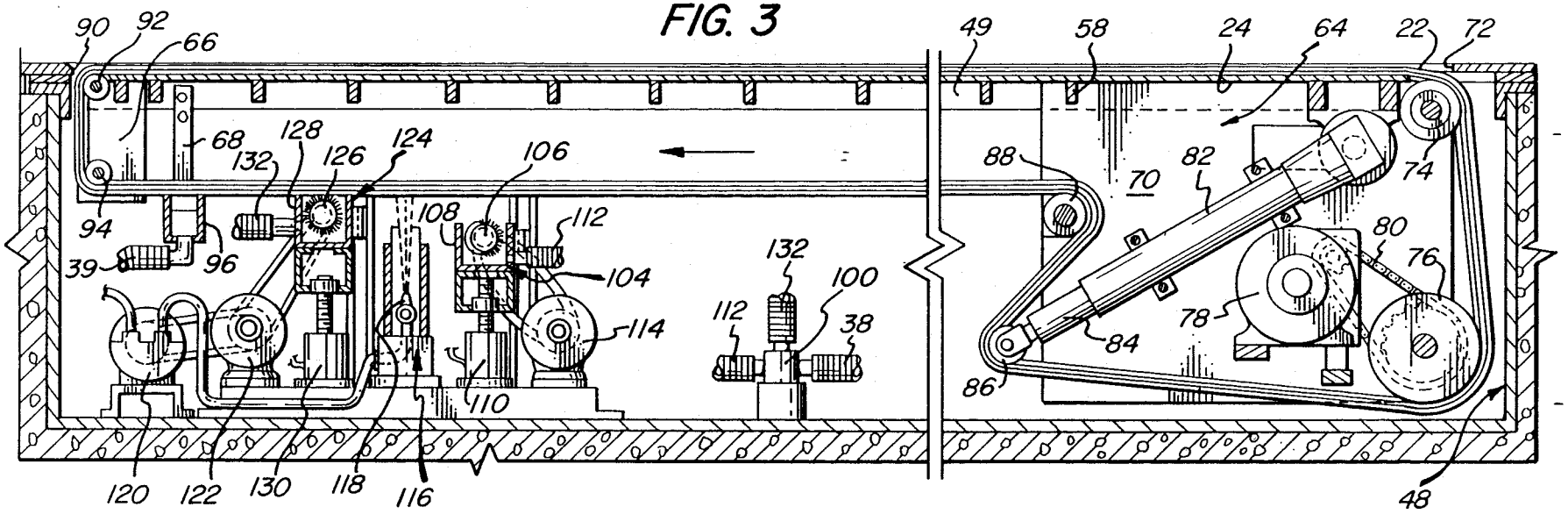
FIG. 3 is a fragmentary longitudinal section thereof.
Figure 7:
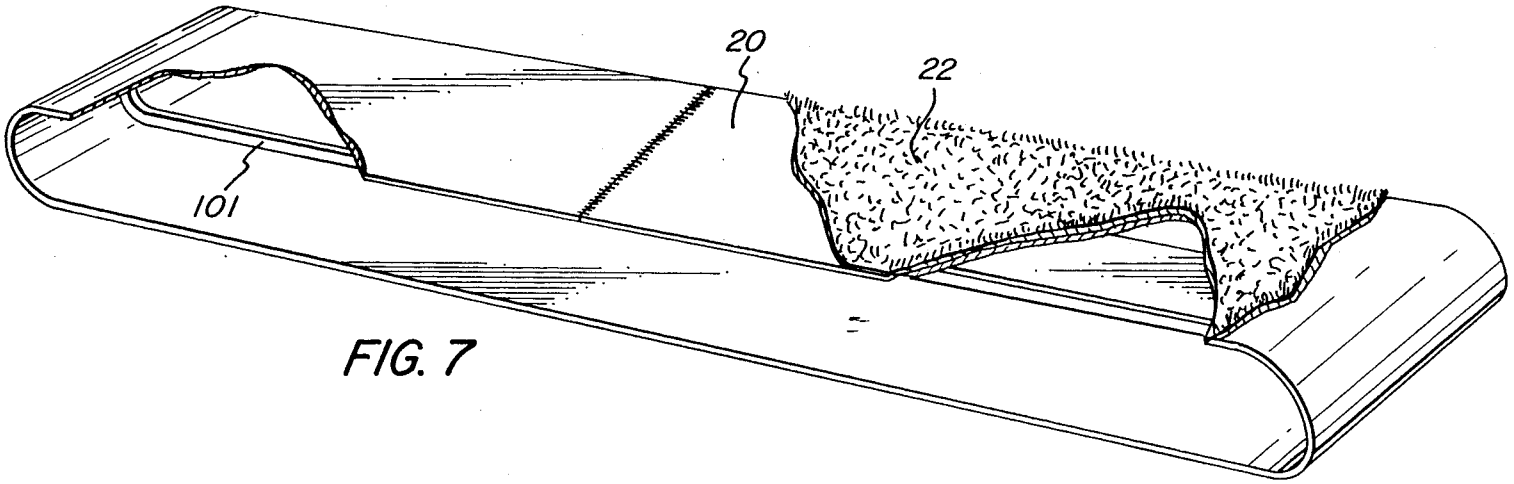
FIG. 7 is a perspective view of the belt and rug with most of the rug omitted and with a portion of the belt broken away.
Figure 8:
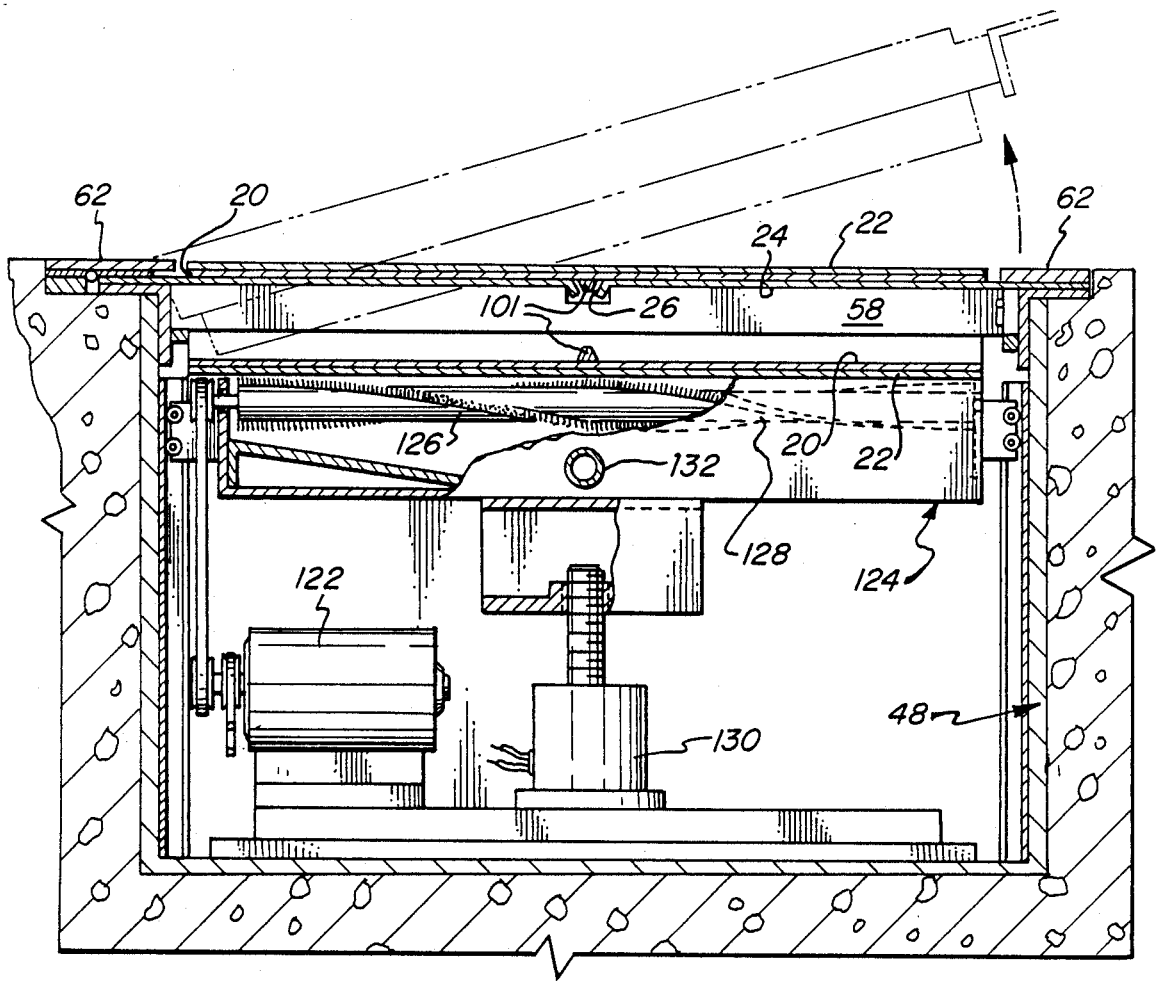
FIG. 8 is a transverse sectional view of the installation.
Figure 9:
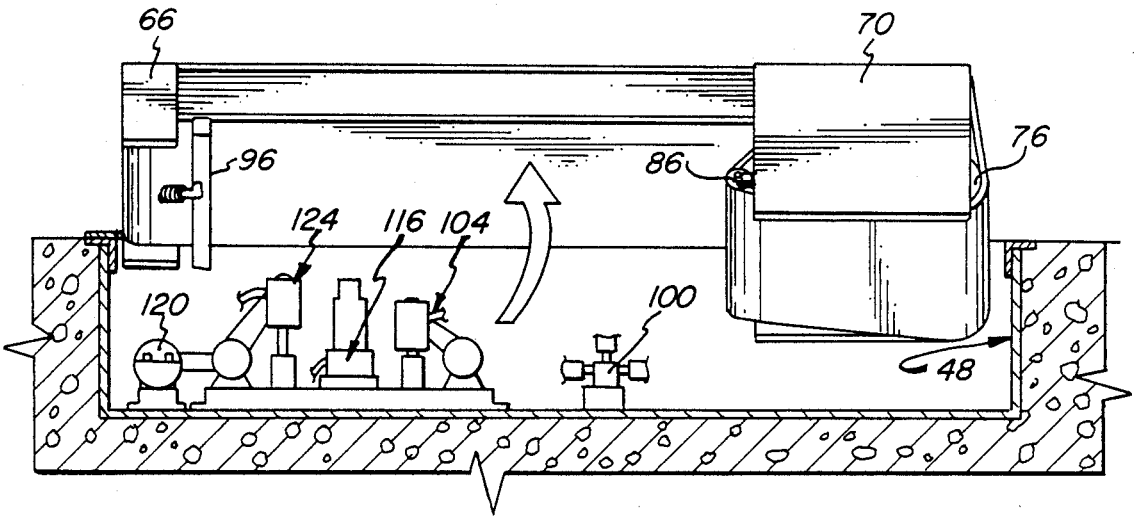
FIG. 9 is a longitudinal view in partial section with the top plate and frame pivoted upwardly.

Turning now to FIGS. 2–6, the housing 14 is comprised of a rectangular metal box generally designated by the numeral 48 with a sidewall 52 and a bottom wall 53, and an inverted L-shaped member 49 provides an outwardly extending flange 50 at the upper end of the sidewall 52. The elongated top plate 24 is pivotably mounted along one side to the flange 50 by the continuous hinge 54 which has its outer leaf secured to the spacer 56. As seen in FIG. 3, the top plate 24 has stiffening bars 58 extending transversely thereof on its bottom surface and the ribs seat on flanges 60 on the member 49 to support the top plate 54 in a stable plane. Along the opposite side, the top plate 24 seats upon the flange 50, and the plate terminates inwardly of the ends of the housing 14 to provide transversely extending apertures 72, 90 thereinto. Overlying the peripheral portion of the installation is a cover molding 62 to provide a substantially flush, attractive surface about the rug 22.

Carried along the sides of the top plate 24 and depending therefrom inwardly of its side margins, is a support frame generally designated by the numeral 64 and comprised of three vertically extending pairs of plates 66, 68 and 70. As best seen in FIGS. 2 and 3, the top plate 24 provides a transversely extending aperture 72 into the housing 14 adjacent its one end and over the large pair of plates 70, and the belt 20 and rug 22 passes into the housing 14 therethrough. Rotatably supported on the plates 70 therebelow are the idler roller 74, and the drive roller 76 which is driven by the electric motor 78 through the sprocket chain assembly 80 Which seats in a toothed circumferential intermediate its length. The plates 70 also carry a pair of hydraulic cylinders 82 with pistons 84. On the ends of the pistons 84 is journalled the idler roller 86 so that this roller 86 may be moved inwardly and outwardly thereby. Above the roller 86 is another idler roller 88. At the opposite end of the top plate 24, the belt 20 and rug 22 extend through the transversely extending aperture 90, and the plates 66 carry a vertically spaced pair of idler rollers 92, 94 therebelow. Carried by the plates 68 is a blower box 96 with a flexible blower hose 39 extending therefrom to the vacuum 36.

Along the side of the top plate 24 opposite the hinge 54, the top plate 24 has recessed eye bolts (not shown) which will receive cables from above to permit the top plate 24 and frame 64, together with the belt rug and rollers, to be pivoted upwardly for servicing of the various components.

As can be seen in FIG. 2, the rollers 74, 76, 86, 88, 92 and 94 all have a central circumferential groove 102 which seats a rib 101 on the bottom surface of the endless belt 20. This rib 101 also seats in the groove 26 of the top plate 24. As a result, the belt 20 and rug 22 are centered in their movement about the endless path defined thereby.

Supported in the bottom wall 53 of the box 48 are other elements of the rug cleaning assembly best seen in FIG. 3. Initially, the rug 22 passes by the beater brush unit generally designated by the numeral 104 which includes the beater brush 106 which is rotatably supported in the collector box 108. The collector box 108 is moved upwardly and downwardly on the threaded shaft of the electric motor 110, and the dirt collected in the box 108 is removed by the flexible vacuum hose 112 which is coupled to the valve unit 100. The beater brush 106 is rotated by the electric motor 114.

After the beater brush unit 104, the rug 22 passes over the spray unit which is generally designated by the numeral 116 and which includes a spray nozzle 118 through which a cleaning liquid is sprayed onto the rug 22. The cleaning liquid is pressurized by the pump 120 which is powered by a drive belt from the motor 122.

The now wetted rug 22 then passes over the beater brush unit generally designated by the numeral 124 which removes the loosened dirt particles and sucks out the washing liquid. As in the instance of the beater brush unit 104, the beater brush 126 is rotatably supported in the collector box 128 which is movable on the threaded shaft of the motor 130 and the dirt and water is collected through the vacuum line 132 and returned to the container of the vacuum 36 in the control unit 30. The beater brush 126 is rotated by the motor 122.

The still wet rug 22 now passes over the blower box 96 where the exhaust air from the vacuum 36 effects drying thereof.

The control unit 30 contains a microprocessor which has a ROM chip containing various instructions in memory to effect operation of the unit in the automatic mode in which the operations are largely time controlled. When the "on" button on the control panel 34 is turned on, the microprocessor will periodically advance the rug 22 about the endless loop and will also periodically perform a cleaning action on the rug 22 as it is being advanced. The periods between advancing motion and between cleaning actions can readily be varied by simple instructions depending upon the amount of soiling that can be expected on any given day.

Upon energization of the control unit 30 for automatic operation, it receives signals from an associated approach or presence sensor (not shown) such as a microwave, light beam interrupt, or ultrasound unit.

Based upon the cycle times selected, the motor 78 will be accelerated to advance the belt 20 and rug 22 approximately one-half a revolution so as to present a clean surface area. If a signal is received from the presence sensor that a person is approaching, the signal to start the motor 78 may be delayed, or, if the motor 78 is operating, the control unit 30 may stop its operation. After a period of time in which no further signal is received from the presence sensor (1–2 minutes), the motor 78 will be activated to effect, or complete the remainder of, the prescribed advance.

If so desired, during the time that the belt 20 and rug 22 are being advanced by the motor 78, the control unit 30 may also activate the beater brush unit 104 and vacuum unit 36 to dislodge dirt from the rug 22 passing thereover and carry it into the receptacle of the vacuum unit 36. The start signal will activate the motor 110 to move the beater brush collector 108 and brush 106 upwardly against the rug 22.

Periodically, the control unit 30 will initiate a rug cleaning cycle in which the motor 110 is activated to move the collector box 108 upwardly against the surface of the rug 22 after the motor 80 has been activated to rotate the belt 20 and rug 22. The motor 114 is activated to rotate the beater brush 106. As a result, the rug 22 is more thoroughly cleaned as the rug 22 is rotated thereover for 10–20 revolutions.

If the presence sensor sends a signal indicating approach of a person, the several motors may be stopped until passage of a predetermined period of time in which no person has been sensed. The cleaning cycle will then be continued.

After the cleaning cycle has been completed, the motor 114 is activated to lower the brush 106 and collector box 108.

When it is desired to wash the rug 22, a washing cycle follows the beater brush cycle. In the washing cycle, the motor 112 is activated to move the collector box 124 and beater brush 126 upwardly. The motor 122 is activated to rotate the beater brush 126 and the pump 120 which sprays cleaning liquid from the tank 40 onto the rug 22 through the nozzle 118. The beater brush 126 removes particles dislodged from the rug 22 and liquid is sucked from the rug 22 by the vacuum in the box 124. The rug 22 continues along its path over the blower box 96 where warm air from the exhaust side of the vacuum cleaner 36 effects further drying. After the prescribed period, the motor 120 is deactivated to terminate the spraying and the rotation of the beater brush 126. The motor 130 is activated to lower the collector box 124 and brush 126.

As in the other operations, a signal from the presence sensor may suspend the washing cycle.

The hydraulic cylinders 82 are connected to a pump (not shown) which is operated by signals from the control unit 30. On the control panel 34 is a gauge indicating the tension on the belt 20 as provided by a tension meter (not shown) disposed along the closed loop of the belt 20. Depending on the programming of the microprocessor, the microprocessor may automatically turn on the pump to adjust the tension on the belt 20 to keep it within defined parameters, or this may be done manually from time to time.

To provide the desired dimensional stability in the belt 20, it is conveniently fabricated from fiberglass webbing or cloth providing a high degree of dimensional stability and strength. The rug is fabricated from synthetic resins which provide low stretch and low moisture retention so as to provide a high degree of dimensional stability upon the belt. The rug may be treated to enhance its resistance to permanent soiling and/or to increase its ability to remove dirt and other matter from the soles of shoes passing thereover.

The rug is secured to the belt at several points spaced along its length, alternatively, ever tacky adhesives, or interlocking loop fasteners such as those sold under the trademark VELCRO, may be applied to the opposed surfaces of the belt and rug to secure the rug firmly to the surface of the belt. To enable mounting of the belt and the rug in the installation, the abutting ends are not secured together until it has been placed about the top plate and rollers. At this time, the two ends are joined together to form the closed loop. Although the two ends can be sewn together, this will tend to produce increased thickness at the joint. Conveniently, the two ends are secured together by an underlying element which is adhered to the adjacent ends of the belt to firmly secure them in abutting engagement.

When it is desired to remove the belt 20 and rug 22 from the unit, the pump is actuated to retract the pistons 84 to remove the tensioning from the belt 20. After a new belt 20 and rug 22 have been assembled about the top plate 24 and rollers, the pump is actuated to move the pistons 84 outwardly and provide the desired tension in the belt for operation.

The vacuum connector 100 is desirably a solenoid operated valve unit so that the vacuum being applied through the conduit 38 may be switched between the conduits 112 and 132 to maximize the vacuum at the particular collector box which is then operational. The signal to control the solenoid valve in the connector 100 is generated by the control unit 30 concurrently with the signal to commence operation of the particular beater brush unit.

Although the exhaust from the vacuum 36 may be supplied through the blower conduit 39 to the blower box 96 at any time that the vacuum 36 is operational, a valve may also be provided adjacent the vacuum to discharge the air from the vacuum 36 to atmosphere rather than through the blower conduit 39 when the spray unit 116 is not activated.

In place of the eye bolts to lift the top plate and associated frame and drive assembly, a hydraulic or other mechanism may be disposed within the housing 14 to move a shaft(s) upwardly to pivot the top plate into its open position. Because the shaft must be located outwardly of the path of the belt 20, this requires that such a mechanism be located so that it acts outwardly of the belt either along the sides of the top plate or at its two ends.

The control unit 30 is one which can function automatically, semi-automatically, or manually to control the various elements of the assembly. In fully automatic operation, the microprocessor is programmed to control tension on the belt, rotation of the belt, cleaning operations and response to signals from approach sensors. A clock mechanism in the control unit controls the cycles in accordance with the program provided in the microprocessor. Conveniently, the program is one which permits the time periods between the various operations to be readily changed by operator input at the control panel.

Alternatively, the unit may be operated semi-automatically so that maintenance personnel will periodically inspect the installation and start the cleaning cycle at appropriate times or merely change the exposed rug surface by moving the belt one-half revolution.

Obviously it is extremely desirable that the control unit also be capable of manual operation of its various elements. Typically, the control panel has switches for each of the motors and pumps to permit such manual operation, and there are indicator lights indicating the status of various of the operative components. As previously indicated, a gauge is provided to indicate the tension upon the belt.

Typically, under conditions which do not involve the transport of considerable soil on the feet of persons passing over the installation, the cleaning cycles will be about eight hours apart. Under such conditions, the typical cleaning cycle will involve 10–30 minutes of operation of the beater brush unit to remove the bulk of the particulate contamination followed by a washing cycle of an equivalent period.

Under conditions involving substantial soiling of the installation, the cycle may be reduced to as little as 10–30 minutes static, 10–30 minutes of beater brush action, and 10–30 minutes of washing action.

Although it is preferable that the belt and rug remain stationary during periods when persons are walking thereover, it is also possible to rotate it at a very slow rate on the order of one-half to one and one-half feet per minute. This may be necessary when the conditions are such that rapid soiling has occurred because it is not possible to conduct the cleaning operations only during periods when persons are not walking over the installation. Thus, the cleaning action is taking place at the same time as the rug is being rotated to provide reasonably clean surfaces to remove soil from the feet of the persons passing thereover.

It will be appreciated that the installation may be readily varied in length by increasing the size of the top plate and spacing of the frame elements which are supported thereon.

As also indicated, the assembly is adapted to use with approach and presence sensors to terminate rotation of the belt when a person is about to walk thereon. These may be in the form of electric eye or beam interrupt units mounted on posts in the approach walkway, or microwave and ultrasound sensors mounted on the building adjacent the entry door. It is possible to comple the unit to the sensors used for opening the door if the sensor scan distance is sufficiently long.

Thus, it can be seen from the foregoing detailed specification and drawings that the self-cleaning entry rug assembly of the present invention is one which will provide highly desirable action in removing soil from the feet of the persons passing thereover while maintaining a desirable surface appearance. The installation is one which is readily adapted to various locations and conditions of soiling and can be readily coupled to presence sensors so that it is operational to effect cleaning action only when persons are not passing thereover. The components of the unit may be fabricated readily from durable components to provide a relatively long lived installation providing relatively trouble installation.

Having thus described the invention, what is claimed is:

1. A self-cleaning entry rug assembly comprising:

(a) a housing having a top plate extending over substantially the entire top of said housing and hingedly supported on a side thereof, said plate providing transversely extending openings into said housing adjacent its opposite ends;

(b) a frame supported on said housing and removable therefrom upon opening of said top plate;

(c) a pair of tread rollers rotatably supported on said frame and extending against said transversely extending openings of said top plate;

(d) a multiplicity of auxiliary rollers rotatably supported on said frame and extending transversely of said plate below said tread rollers;

(e) an endless belt extending in a closed path about said tread rollers, over said top plate and about said auxiliary rollers in said housing;

(f) an endless rug supported on said endless belt for movement therewith;

(g) cleaning means in said housing below said closed path for cleaning said endless rug as it passes thereover;

(h) means for movement of at least one of said auxiliary rollers to vary the length of said closed path and thereby the tension on said belt;

(i) means for effecting rotation of at least one of said rollers to effect rotation of said belt and thereby said rug; and (j) control means for controlling said rotation means and cleaning means.

2. The self-cleaning entry rug assembly in accordance with claim 1 wherein said belt has at least one rib on its lower surface and wherein said top plate has a groove extending longitudinally thereof in which said rib slidably seats.

3. The self-cleaning entry rug assembly in accordance with claim 2 wherein said tread rollers have grooves in their circumference in which said rib is seated.

4. The self-cleaning entry rug assembly in accordance with claim 3 wherein said auxiliary rollers have grooves in their circumference in which said rib is seated.

5. The self-cleaning entry rug assembly in accordance with claim 1 wherein said cleaning means include a beater and vacuum unit to dislodge and remove particles of dirt and dust from said rug.

6. The self-cleaning entry rug assembly in accordance with claim 5 wherein said cleaning means additionally includes a washing unit for spraying a liquid on said rug to wash the surface thereof.

7. The self-cleaning entry rug assembly in accordance with claim wherein said cleaning assembly additionally includes conduits extending from said cleaning means in said housing for removal of dirt from said cleaning means, and to supply, and to remove spent, washing liquid to and from said cleaning means.

8. The self-cleaning entry rug assembly in accordance with claim 5 wherein said beater and vacuum unit includes a collector and vacuum housing in which a beater brush is supported, and means for moving said housing upwardly against said rug during cleaning action and downwardly thereafter.

9. The self-cleaning entry rug assembly in accordance with claim 1 wherein said assembly additionally includes conduits extending from said cleaning means in said housing for transport of dirt and other materials therethrough to external receptacles.

10. The self-cleaning entry rug assembly in accordance with claim 1 wherein said means for moving at least one of said auxiliary rollers includes at least one hydraulic cylinder to effect movement of said one auxiliary roller.

11. The self-cleaning entry rug assembly in accordance with claim 1 wherein said frame is supported on said top plate so as to be movable therewith, said cleaning means being exposed upon opening of said top plate.

12. The self-cleaning entry rug assembly in accordance with claim 1 wherein said control means includes a microprocessor which is programmable to vary the operation and timing of the operation of said rotation means and cleaning means.

13. The self-cleaning entry rug assembly in accordance with claim 12 wherein said microprocessor cooperates with said movement means for tensioning the belt and with tension measuring means to maintain substantially predetermined tension on said belt.

14. The self-cleaning entry rug assembly in accordance with claim 1 wherein said control means is adapted to receive a signal from presence sensing means adjacent the entry rug assembly to terminate rotation of said rollers upon approach of a person towards said assembly.

15. The self-cleaning entry rug assembly in accordance with claim 14 wherein said control means includes means for timing the length of a cleaning cycle to effect operation of said rotation means and said cleaning means for the period of such cycle, to terminate operation of said rotation means and cleaning means during the approach and passage of a person over said assembly, and then to reinstitute the operation of said rotation and cleaning means for the remaining period of said cycle.

16. The self-cleaning entry rug assembly in accordance with claim 15 wherein said control means effects operation of said rotation means and cleaning means only after a minimum interval of time during which no signal has been received from the associated presence sensor.

17. A self-cleaning entry rug assembly comprising:

(a) a housing having a top plate extending over substantially the entire top of said housing and hingedly supported on a side thereof, said plate providing transversely extending openings into said housing adjacent its opposite ends;

(b) a housing supported on said housing and removable from the housing upon opening of said top plate;

(c) a pair of tread rollers rotatably supported on said frame and extending adjacent said transversely extending openings of said top plate;

(d) a multiplicity of auxiliary rollers rotatably supported on said frame and extending transversely of said plate below said tread rollers;

(e) an endless belt extending in a closed path about said tread rollers, over said top plate and about said auxiliary rollers in said housing;

(f) an endless rug supported on said endless belt for movement therewith;

(g) cleaning means in said housing below said closed path for cleaning said endless rug as it passes thereover, said cleaning means including a beater and vacuum unit to dislodge and remove particles of dirt and dust from said rug and a washing unit for spraying a liquid on said rug to wash its surface, said cleaning means also including conduits extending from said cleaning means in said housing for removal of dirt and to supply and remove washing liquid;

(h) means for movement of at least one of said auxiliary rollers to vary the length of said closed path and thereby the tension on said belt;

(i) means for effecting rotation of at least one of said rollers to effect rotation of said belt and thereby said rug; and (j) automatic control means for controlling said rotation means, and cleaning means, and including a microprocessor which is programmable to vary the operation and timing of the operation of said rotation means and cleaning means, said automatic control means being adapted to receive a signal from presence sensing means adjacent the entry rug assembly to terminate rotation of said rollers upon approach of a person towards said assembly.

18. The self-cleaning entry rug assembly in accordance with claim 17 wherein said control means includes means for timing the length of a cleaning cycle to effect operation of said rotation means and said cleaning means for the period of such cycle, to terminate operation of said rotation means and cleaning means during the approach to and passage of a person over said assembly, and then to reinstitute the operation of said rotation and cleaning means for the remaining period of said cycle.

19. The self-cleaning entry rug assembly in accordance with claim 18 wherein said automatic control means effects operation of said rotation means and cleaning means only after a minimum interval of time during which no signal has been received from the associated presence sensor.

20. The self-cleaning entry rug assembly in accordance with claim 17 wherein said belt has at least one rib on its lower surface and wherein said top plate, and said tread rollers have grooves in their circumference in which said rib is seated.

21. The self-cleaning entry rug assembly in accordance with claim 17 wherein said means for moving at least one of said auxiliary rollers includes at least one hydraulic cylinder to effect movement of said auxiliary roller, and wherein said microprocessor cooperates with said movement means for tensioning the belt and with tension measuring means to maintain substantially predetermined tension on said belt.

22. The self-cleaning entry rug assembly in accordance with claim 17 wherein said beater and vacuum unit includes a collector and vacuum housing in which a beater brush is supported, and means for moving said housing upwardly against said rug during cleaning action and downwardly thereafter.

* * * * *

UNITED STATES PATENT AND TRADEMARK OFFICE

CERTIFICATE OF CORRECTION

PATENT NO. : 4,951,345

DATED : August 28, 1990

INVENTOR(S) : John J. Nappi, Sr.

It is certified that error appears in the above-identified patent and that said Letters Patent is hereby corrected as shown below:

Column 8, line 53, after "Claim", insert -- 6 --.

Column 9, line 48, "housing" (first occurrence) should be -- frame --.

Signed and Sealed this

Twenty-first Day of January, 1992

*Attest:*

HARRY F. MANBECK, JR.

*Attesting Officer*

*Commissioner of Patents and Trademarks*